US009584919B2

(12) United States Patent
Hung et al.

(10) Patent No.: US 9,584,919 B2
(45) Date of Patent: Feb. 28, 2017

(54) INTERFACE SWITCHING SYSTEM AND METHOD FOR SWITCHING OPERATION MODE

(71) Applicant: Wistron Corp., New Taipei (TW)

(72) Inventors: Chien-Ting Hung, New Taipei (TW); Chung-Hung Sung, New Taipei (TW)

(73) Assignee: WISTRON CORP., New Taipei (TW)

( * ) Notice: Subject to any disclaimer, the term of this patent is extended or adjusted under 35 U.S.C. 154(b) by 658 days.

(21) Appl. No.: 14/065,661

(22) Filed: Oct. 29, 2013

(65) Prior Publication Data

US 2014/0177878 A1 Jun. 26, 2014

(30) Foreign Application Priority Data

Dec. 25, 2012 (TW) ..... 101149695 A

(51) Int. Cl.
*H04R 5/04* (2006.01)

(52) U.S. Cl.
CPC ..... *H04R 5/04* (2013.01); *H04R 2420/09* (2013.01)

(58) Field of Classification Search
CPC ..... H04R 3/00
USPC ..... 381/74, 78, 123; 439/638, 676; 710/62
See application file for complete search history.

(56) References Cited

U.S. PATENT DOCUMENTS 8,798,285 B2 * 8/2014 Hung ..... G06F 13/409 381/74
2006/0288139 A1 * 12/2006 Lee ..... G06F 1/16 710/62
2011/0093643 A1 4/2011 Hung et al.
2011/0294359 A1 * 12/2011 Cho ..... H01R 29/00 439/676

* cited by examiner

*Primary Examiner* — Md S Elahee
(74) *Attorney, Agent, or Firm* — McClure, Qualey & Rodack, LLP

(57) ABSTRACT

The present invention discloses an interface switching system including an electronic device, wherein the electronic device includes an audio socket, a first set of interface lines, a set of audio interface lines, a first switching device, an interface socket and a processor. The audio socket is arranged to be coupled to an audio plug. The first switching device is arranged to couple the audio socket to the first set of interface lines or the set of audio interface lines. The interface socket is arranged to be coupled to a first interface plug or a second interface plug. The processor is arranged to enable the first switching device to couple the audio socket to the first set of interface lines when the interface socket is coupled to the second interface plug.

14 Claims, 5 Drawing Sheets

INTERFACE SWITCHING SYSTEM AND METHOD FOR SWITCHING OPERATION MODE

CROSS REFERENCE TO RELATED APPLICATIONS

This Application claims priority of Taiwan Patent Application No. 101149695, filed on Dec. 25, 2012, the entirety of which is incorporated by reference herein.

BACKGROUND OF THE INVENTION

Field of the Invention

The present invention relates to an interface switching system, and in particular to an interface switching system arranged to switch the operation mode according to different plugs.

Description of the Related Art

Presently, mobile devices are highly developed and multi-functional. For example, handheld devices such as mobile phones and tablets are capable of conducting telecommunications, receiving and transmitting e-mails, maintaining social networks, managing contacts, and playing media. Hence, users can implement various applications on their mobile devices, such as a simple phone call, social network interaction, or commercial transaction. Therefore, mobile devices have become one of the necessities in people's lives.

Most of the current handheld devices include various sockets (output ports) arranged to connect to other electronic device for extensions. However, the size of the latest handheld devices is required to be small to make them easier for daily use. Therefore, the slots of the current handheld devices are limited, such that it is necessary to use these limited sockets effectively.

BRIEF SUMMARY OF THE INVENTION

A detailed description is given in the following embodiments with reference to the accompanying drawings.

The present invention discloses an interface switching system including an electronic device, wherein the electronic device includes an audio socket, a first set of interface lines, a set of audio interface lines, a first switching device, an interface socket, and a processor. The audio socket is arranged to be coupled to an audio plug. The first switching device is arranged to couple the audio socket to the first set of interface lines or the set of audio interface lines. The interface socket is arranged to be coupled to a first interface plug or a second interface plug. The processor is arranged to enable the first switching device to couple the audio socket to the first set of interface lines when the interface socket is coupled to the second interface plug.

Additionally, the present invention further discloses an operation switching method. The operation switching method is applied to an interface switching system, wherein the operation switching method includes: coupling an audio socket to a set of audio interface lines; determining whether an interface socket is coupled to a first interface plug or a second interface plug; and uncoupling the audio socket from the set of audio interface lines and coupling the audio socket to a first set of interface lines when the interface socket is coupled to the second interface plug.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
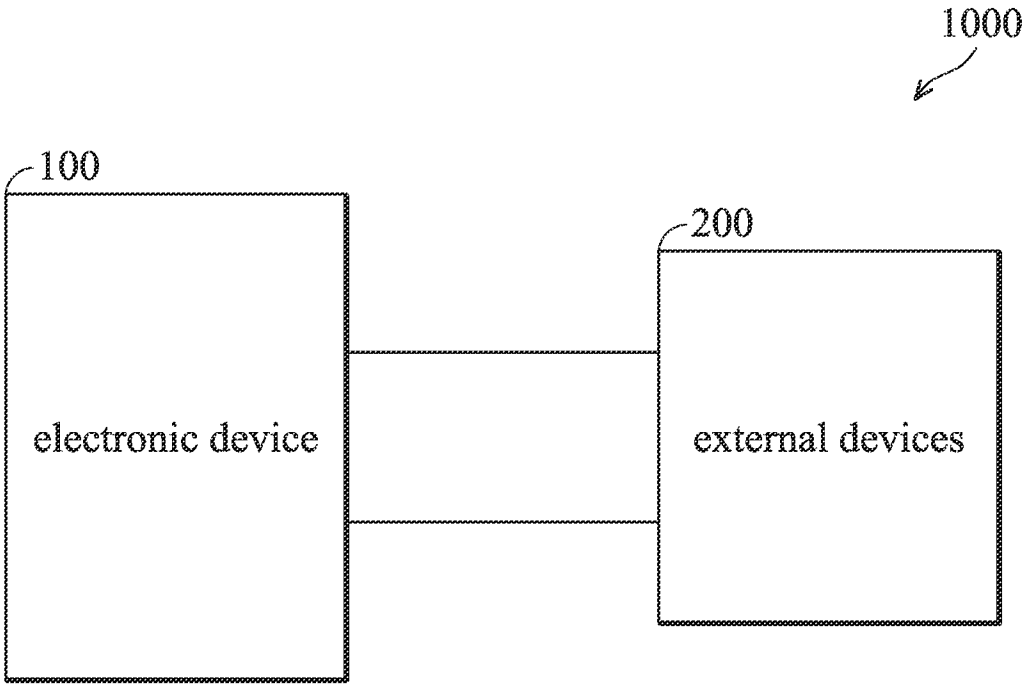
FIG. 1 is a schematic diagram illustrating an embodiment of an interface switching system of the present invention.

FIG. 1 is a schematic diagram illustrating an embodiment of an interface switching system of the present invention. The interface switching system 1000 includes an electronic device 100 and an external device 200. The electronic device 100 is arranged to transfer data with other devices according to a first interface specification, a second interface specification and/or an audio interface specification. For example, the electronic device 100 is arranged to transfer data to the external device 200, but it is not limited thereto. The external device 200 is arranged to be connected to the electronic device 100, and transfer data with the electronic device 100. The electronic device 100 is in a switched mode when the electronic device 100 is connected to the external device 200. The electronic device 100 is in a normal operating mode when the electronic device 100 is not connected to the external device 200.

Figure 2:
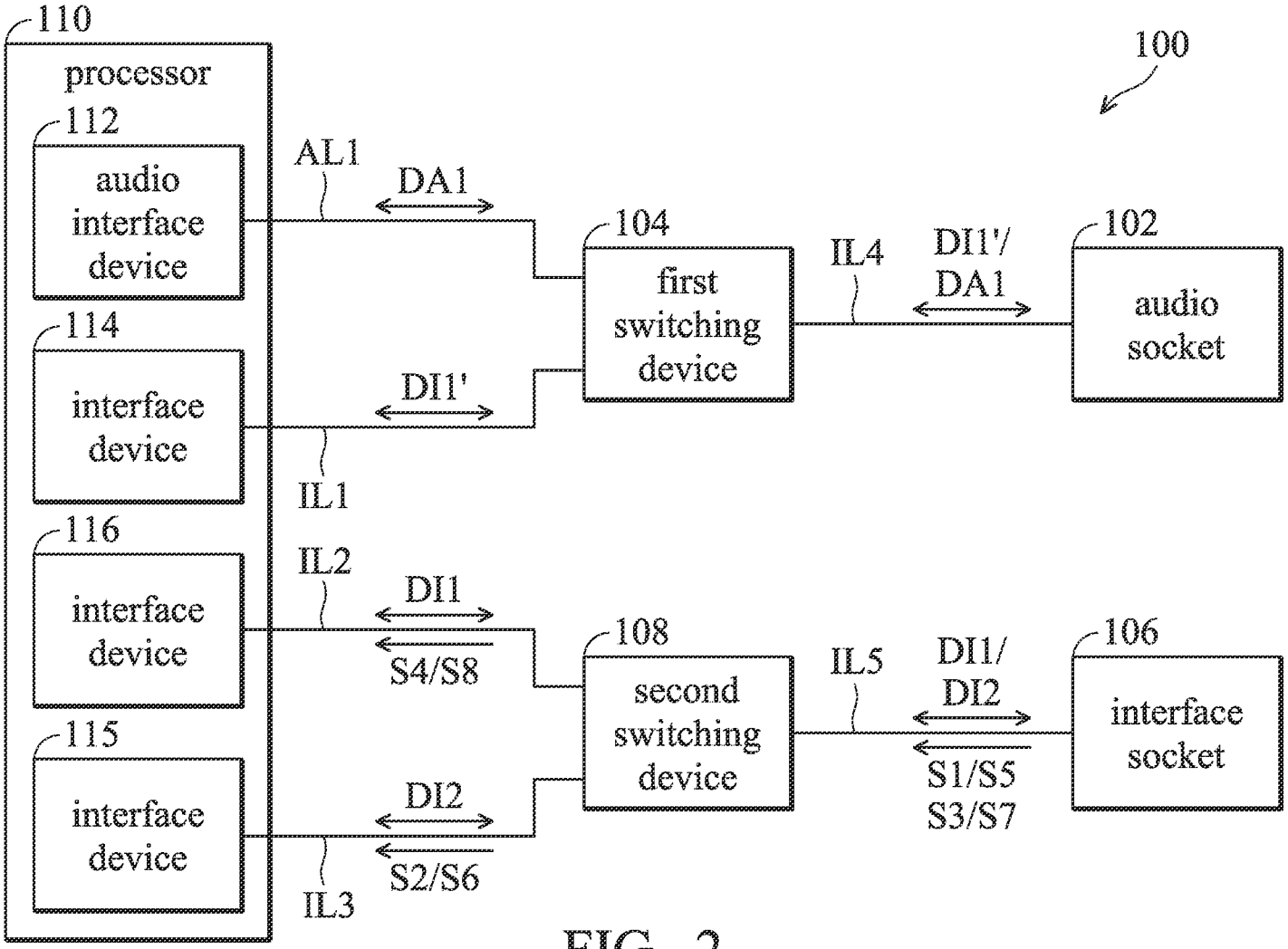
FIG. 2 is a schematic diagram illustrating an embodiment of an electronic device of the present invention.

FIG. 2 is a schematic diagram illustrating an embodiment of an electronic device of the present invention. The electronic device 100 includes an audio socket 102, a first switching device 104, an interface socket 106, a second switching device 108, and a processor 110. It should be noted that the audio socket 102, the first switching device 104, the interface socket 106, the second switching device 108, and the processor 110 are connected and arranged to transfer data with each other via a plurality of sets of interface lines IL1-IL5 and a set of audio interface lines AL1.

The audio socket 102 is arranged to be coupled to an audio plug, and coupled to the first switching device 104 by the set of interface lines IL4. It should be noted that the external device 200 is arranged to be connected to the audio socket 102 of the electronic device 100 by an audio plug, but it is not limited thereto. The audio socket 102 can be coupled to the audio socket of other devices. For example, the audio socket 102 can be a 3.5 mm audio port, and the audio plug can be a 3.5 mm audio plug, but it is not limited thereto. The set of interface lines IL4 is arranged to transfer audio data DA1 which is meeting the audio interface specification in the normal operating mode. Furthermore, the set of interface lines IL4 is arranged to transfer data DI1' which is meeting the first interface specification in the switched mode. Namely, the set of interface lines IL4 is a shared circuit for the first interface and the audio interface. For example, when the audio socket 102 is a 3.5 mm audio port, the set of interface lines IL4 includes at least three data lines. In the normal operating mode, the three data lines of the set of interface lines IL4 are arranged to transfer data for the left channel, the right channel, and the microphone. In the switched mode, the three data lines of the set of interface lines IL4 are arranged to transfer the data of the first interface. In one of the embodiments, the first interface can be a Universal Serial Bus (USB) interface, but it is not limited thereto. When the first interface is a Universal Serial Bus interface, the three data lines of the set of interface lines IL4 is arranged to transfer the first data (USB_DP), the second data (USB_DM), and the identification code (USB_ID) of the USB in the switched mode, but it is not limited thereto.

The first switching device 104 is arranged to selectively couple the audio socket 102 to the set of interface lines IL1 or the set of audio interface lines AL1 through the set of interface lines IL4. For example, in the normal operating mode, the first switching device 104 couples the audio socket 102 to the set of audio interface lines AL1 through the set of interface lines IL4, such that the processor 110 can couple to the audio socket 102 through the set of audio interface lines AL1 and the set of interface lines IL4 to transmit audio data DA1 meeting the audio interface specification to the audio socket 102 and receive audio data DA1 meeting the audio interface specification from the audio socket 102. Namely, the set of audio interface lines AL1 is arranged to transfer audio data DA1 which is meeting the audio interface specification. For example, the set of audio interface lines AL1 includes at least three data lines arranged to transfer data for the left channel, the right channel, and the microphone, but it is not limited thereto. In the switched mode, the first switching device 104 couples the audio socket 102 to the set of interface lines IL1, such that the processor 110 can be coupled to the audio socket 102 through the set of interface lines IL1 and the set of interface lines IL4 to transmit data DI1' which is meeting the first interface specification to the audio socket 102 and receive data DI1' which is meeting the first interface specification from the audio socket 102. Namely, the set of interface lines IL1 is arranged to transfer data DI1' which is meeting the first interface specification. For example, when the first interface is a Universal Serial Bus interface, the set of interface lines IL1 includes at least three data lines arranged to transfer the first data (USB_DP), the second data (USB_DM), and the identification code (USB_ID) of the USB, but it is not limited thereto. It should be noted that the audio socket 102 can only be coupled to one of the set of interface lines IL1 and the set of audio interface lines AL1.

The interface socket 106 is arranged to be coupled to a first interface plug or a second interface plug, and to be coupled to the second switching device 108 through the set of interface lines IL5, wherein the first interface plug meets the first interface specification, and the first interface plug is arranged to transfer data DI1 which is meeting the first interface specification. Moreover, the second interface plug meets the second interface specification, and the second interface plug is arranged to transfer data DI2 which is meeting the second interface specification. In one of the embodiments, the second interface is a Mobile High-Definition Link (MHL) interface, but it is not limited thereto. Namely, the set of interface lines IL5 is a shared circuit for the first interface and the second. For example, when the first interface is a Universal Serial Bus interface and the second interface is a Mobile High-Definition Link interface, the set of interface lines IL5 includes at least three data lines. In the normal operating mode, the three data lines of the set of interface lines IL5 are arranged to transfer the first data (USB_DP), the second data (USB_DM), and the identification code (USB_ID) of the USB in the switched mode. In the switched mode, the three data lines of the set of interface lines IL5 are arranged to transfer the first data (MHL_DP), the second data (MHL_DM), and the identification code (MHL_CUBS) of MHL. It should be noted that the external device 200 can be connected to the interface socket 106 of the electronic device 100 by a second interface plug, but it is not limited thereto. The interface socket 106 can be coupled to the interface plug of other devices. It should be noted that the interface socket 106 is a shared socket for the first interface plug and the second interface plug. For example, when the first interface is a Universal Serial Bus interface and the second interface is a Mobile High-Definition Link interface, the interface socket 106 is a shared socket for the Universal Serial Bus plug and the Mobile High-Definition Link plug, but it is not limited thereto.

The second switching device 108 can be selectively coupled to the processor 110 through the set of interface lines IL2 or the set of interface lines IL3, and coupled to the interface socket 106 through the set of interface lines IL5. When the interface socket 106 is coupled to the first interface plug, the second switching device 108 couples the interface socket 106 to the set of interface lines IL2, wherein the second switching device 108 is further arranged to transmit the data DI1 which is meeting the first interface specification and received from the first interface plug to the processor 110, and transmit the data DI1 which is meeting the first interface specification and received from the processor 110 to the first interface plug. Namely, in the normal operating mode, the second switching device 108 couples the interface socket 106 to the set of interface lines IL2, wherein the second switching device 108 is further arranged to transmit the data DI1 which is meeting the first interface specification and received from the first interface plug to the processor 110, and transmit the data DI1 which is meeting the first interface specification and received from the processor 110 to the first interface plug. Namely, the second switching device 108 is arranged to transfer data with the first interface plug through the set of interface lines IL5 according to a first interface specification and transfer data with the processor 110 through the set of interface lines IL2 according to the first interface specification when the interface socket 106 is coupled to the first interface plug. When the interface socket 106 is coupled to the second interface plug, the second switching device 108 couples the interface socket 106 to the set of interface lines IL3 for transmitting the data DI2 which is meeting the second interface specification and received from the second interface plug to the processor 110 and transmitting the data DI2 which is meeting the second interface specification and received from the processor 110 to the second interface plug. Namely, in the switched mode, the second switching device 108 couples the interface socket 106 to the set of interface lines IL3 for transmitting the data DI2 which is meeting the second interface specification and received from the second interface plug to the processor 110 and transmitting the data DI2 which is meeting the second interface specification and received from the processor 110 to the second interface plug. Namely, when the interface socket 106 is coupled to the second interface plug, the second switching device 108 is arranged to transfer data with the second interface plug through the set of interface lines IL5 according to the second interface specification and transfer data with the processor 110 through the set of interface lines IL2 according to the second interface specification. It should be noted that the set of interface lines IL2 and the set of interface lines IL3 cannot be coupled to the processor 110 at the same time.

Namely, the set of interface lines IL2 is arranged to transmit data DI1 which meets the first interface specification. For example, when the first interface is a Universal Serial Bus (USB) interface, the set of interface lines IL1 includes at least three data lines, wherein the three data lines are arranged to transfer the first data (USB_DP), the second data (USB_DM), and the identification code (USB_ID) of the USB, but it is not limited thereto. Moreover, the set of interface lines IL3 is arranged to transfer data DI2 which meets the second interface specification. For example, when the second interface is a Mobile High-Definition Link (MHL) interface, the set of interface lines IL3 includes at least three data lines, wherein the three data lines are arranged to transfer the first data (MHL_DP), the second data (MHL_DM), and the identification code (MHL_CUBS) of the MHD, but it is not limited thereto.

In one of the embodiments, when the interface socket 106 is coupled to the second interface plug, the interface socket 106 receives a first identification signal S1 from the second interface plug and transmits the first identification signal S1 to the second switching device 108. Moreover, the second switching device 108 is further arranged to produce a second identification signal S2 according to the first identification signal S1, and transmit the second identification signal S2 to the processor 110. When the interface socket 106 is coupled to the first interface plug, the interface socket 106 receives a third identification signal S3 from the first interface plug, and transmits the third identification signal S3 to the second switching device 108. Moreover, the second switching device 108 produces a fourth identification signal S4 according to the third identification signal S3, and transmits the fourth identification signal S4 to the processor 110. In one of the embodiments, the second switching device 108 switches according to the first identification signal S1 or the third identification signal S3, but it is not limited thereto. In other embodiments, the second switching device 108 is coupled to the processor 110 selectively through the set of interface lines IL2 or the set of interface lines IL3 in response to the normal operating mode or the switched mode.

The processor 110 is arranged to enable the electronic device 100 to operate in a switched mode when the interface socket 106 is coupled to the second interface plug. Next, the processor 110 is further arranged to enable the first switching device 104 to couple the audio socket 102 to the set of interface lines IL1 and enable the second switching device 108 to couple the interface socket 106 to the set of interface lines IL3 in the switched mode. When the interface socket 106 is decoupled from the second interface plug, the processor 110 is further arranged to enable the electronic device 100 to operate in a normal operating mode. Next, the processor 110 is further arranged to enable the first switching device 104 to couple the audio socket 102 to the set of audio interface lines AL1 and enable the second switching device 108 to couple the interface socket 106 to the set of interface lines IL2 in the normal operating mode. For example, the processor 110 is arranged to enable the electronic device 100 to enter the switched mode according to the second identification signal S2 produced by the second switching device 108, and enable the electronic device 100 to enter the normal operating mode according to the fourth identification signal S4 produced by the second switching device 10.

In another embodiment, the processor 110 is further arranged to determine whether the second interface plug is uncoupled from the interface socket 106. For example, when the second interface plug is uncoupled from the interface socket 106, the interface socket 106 produces a fifth identification signal S5, and transmits the fifth identification signal S5 to the second switching device 108. The second switching device 108 produces a sixth identification signal S6 according to the fifth identification signal S5 and transmits the sixth identification signal S6 to the processor 110. Therefore, the processor 110 can determine that the second interface plug is uncoupled from the interface socket 106 according to the sixth identification signal S6, and enable the electronic device 100 to return to operating in the normal operating mode. Moreover, the processor 110 is further arranged to determine whether the first interface plug is uncoupled from the interface socket 106. For example, when the first interface plug is uncoupled from the interface socket 106, the interface socket 106 produces a seventh identification signal S7 and transmits the seventh identification signal S7 to the second switching device 108. The second switching device 108 produces an eighth identification signal S8 according to the seventh identification signal S7, and transmits the eighth identification signal S8 to the processor 110. Therefore, the processor 110 can determine that the first interface plug is uncoupled from the interface socket 106 according to the eighth identification signal S8.

The processor 110 further includes an audio interface device 112 and a plurality of interface devices 114-116. Moreover, the processor 110 can further include a central-processing unit (CPU) or a plurality of processing units relating to the parallel processing environment for executing instructions and enabling the devices of the electronic device 100. It should be noted that the processor 110 can further include a memory device (not shown) including flash ROM and/or random access memory (RAM) for storing the programs for the processor 110, such as software code SC1. Generally, programs include routines, programs, objects, components, etc. for dynamically transmitting or receiving data. It should be noted that, in another embodiment, a memory device can be also implemented outside of the processor 110. The processor 110 updates software by covering the original software code by the software code SC1. Moreover, the software can be application software for the electronic device 100, such as an operation system (OS), drivers, etc., and it is not limited thereto.

The audio interface device 112 is arranged to transmit audio data DA1 which meets the audio interface specification to the audio plug and receive audio data DA1 which meets the audio interface specification from the audio plug through the set of audio interface lines AL1 and the set of interface lines IL4 when the interface socket 106 is coupled to the first interface plug. Namely, in the normal operating mode, the audio interface device 112 is arranged to transmit audio data DA1 which meets the audio interface specification to the audio plug and receive audio data DA1 which meets the audio interface specification from the audio plug through the set of audio interface lines AL1 and the set of interface lines IL4.

The first interface device 114 is arranged to transmit the data DI1' which meets the first interface specification to the audio plug and receive the data DI1' which meets the first interface specification from the audio plug through the set of interface lines IL1 and the set of interface lines IL4 when the interface socket 106 is coupled to the second interface plug. Namely, in the switched mode, the first interface device 114 is arranged to transmit the data DI1' which meets the first interface specification to the audio plug and receive the data DI1' which meets the first interface specification from the audio plug through the set of interface lines IL1 and the set of interface lines IL4.

The second interface device 115 is arranged to transmit data DI2 which meets the second interface specification to the interface plug and receive data DI2 which meets the second interface specification from the interface plug through the set of interface lines IL3 and the set of interface lines IL5 when the interface socket 106 is coupled to the second interface plug. Namely, in the switched mode, the second interface device 115 is arranged to transmit data DI2 which meets the second interface specification to the interface plug and receive data DI2 which meets the second interface specification from the interface plug through the set of interface lines IL3 and the set of interface lines IL5.

The third interface device 116 is arranged to transmit data DI1 which meets the first interface specification to the interface socket 106 and receive data DI1 which meets the first interface specification from the interface socket 106 through the set of interface lines IL2 and the set of interface lines IL5 when the interface socket 106 is coupled to the first interface plug. Namely, in the normal operating mode, the third interface device 116 is arranged to transmit data DI1 which meets the first interface specification to the interface socket 106 and receive data DI1 which meets the first interface specification from the interface socket 106 through the set of interface lines IL2 and the set of interface lines IL5.

Figure 3:
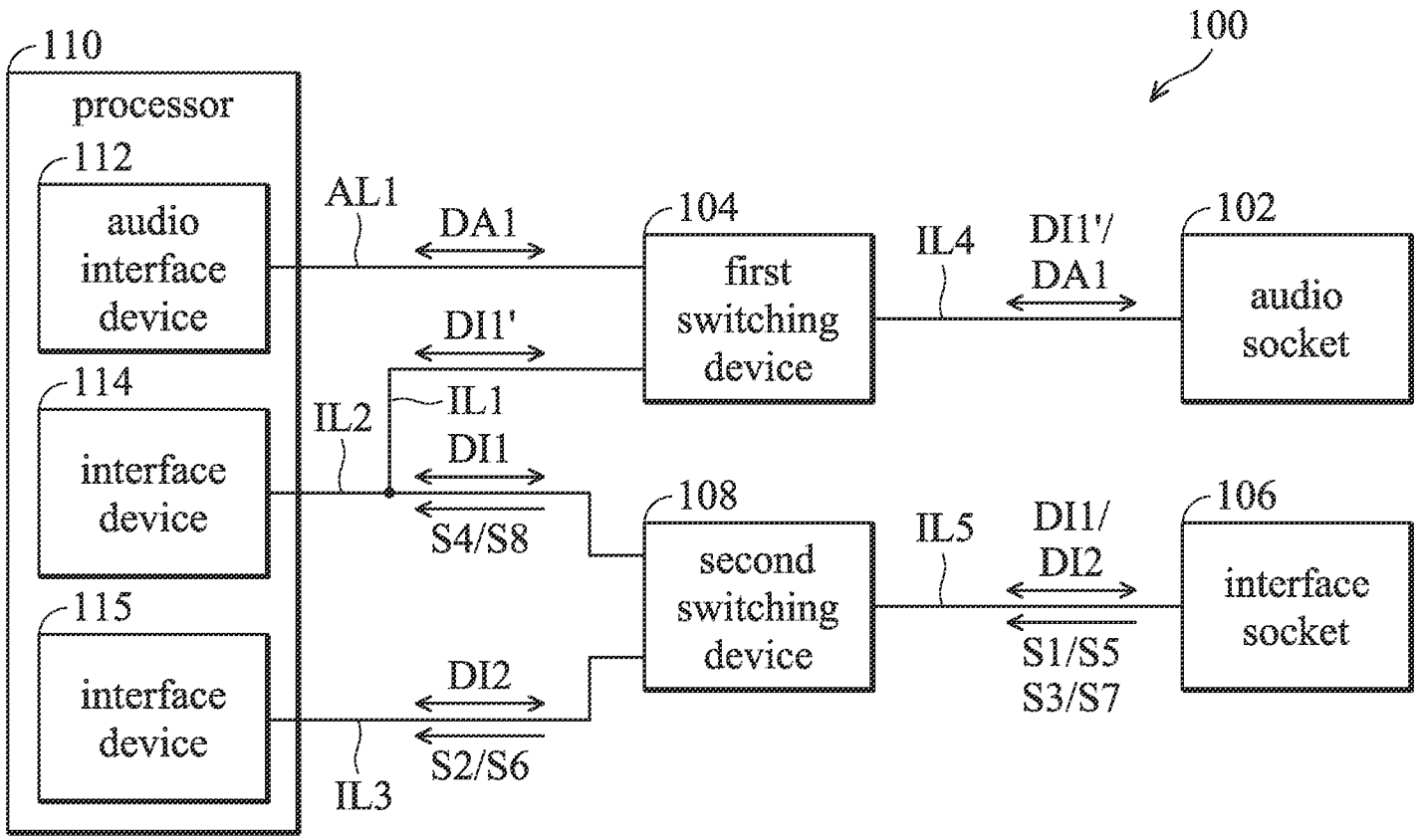
FIG. 3 is a schematic diagram illustrating another embodiment of an electronic device of the present invention.

FIG. 3 is a schematic diagram illustrating another embodiment of an electronic device of the present invention. The electronic device 100 of FIG. 3 is similar to the electronic device 100 of FIG. 2 except that the processor 110 of FIG. 3 does not include the interface device 116 and the second set of interface lines IL2 of FIG. 3 is connected to the first set of interface lines IL1. Namely, the interface device 114 of the processor 110 of FIG. 3 is arranged to transfer data with the audio socket 102 and second switching device 108 through the first set of interface lines IL1 and the second set of interface lines IL2. The descriptions of the other devices can be referred to in FIG. 2.

Figure 4:
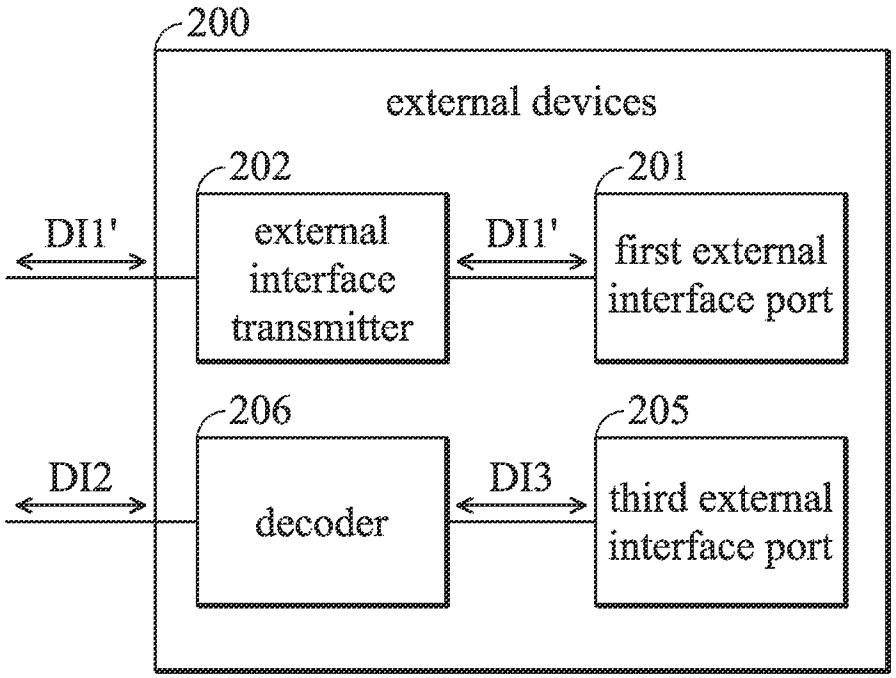
FIG. 4 is a schematic diagram illustrating an embodiment of an external device of the present invention.

FIG. 4 is a schematic diagram illustrating an embodiment of an external device of the present invention. The external device 200 includes a first external interface port 201, an external interface transmitter 202, a third external interface port 205 and a decoder 206.

The first external interface port 201 can be a plug or a socket meeting the first interface specification for transmitting data DI1' which is meeting the first interface specification and received from the external interface transmitter 202 to other devices and transmitting data DI1' which is meeting the first interface specification and received from other devices to the external interface transmitter 202.

The external interface transmitter 202 is arranged to transmit data DI1' which is meeting the first interface specification and received from the first external interface port 201 to the electronic device 100 through the audio plug and transmit data DI1' which is meeting the first interface specification and received from the electronic device 100 to the first external interface port 201. It should be noted that the external interface transmitter 202 is further arranged to assign the data output by the different pins of the audio plug to the pins of the first external interface port 201.

The third external interface port 205 can be a plug or a socket meeting the third interface specification for transfer data DI3 which is meeting the third interface specification and received from the decoder 206 to other devices, and transmit data DI3 which is meeting the third interface specification and received from other devices to the decoder 206.

The decoder 206 is arranged to convert data DI3 which is meeting the third interface specification and received from the third external interface port 205 to data DI2 which is meeting the second interface specification, and transmit the converted data DI2 to the electronic device 100 by the second interface plug. The decoder 206 is further arranged to convert data DI2 which is meeting the second interface specification and received from the electronic device 100 to data DI3 which is meeting the third interface specification, and transmit the converted data DI3 to the third external interface port 205. For example, when the second interface is a Mobile High-Definition Link (MHL) interface, the third interface can be a High Definition Multimedia Interface (HDMI).

Figure 5:
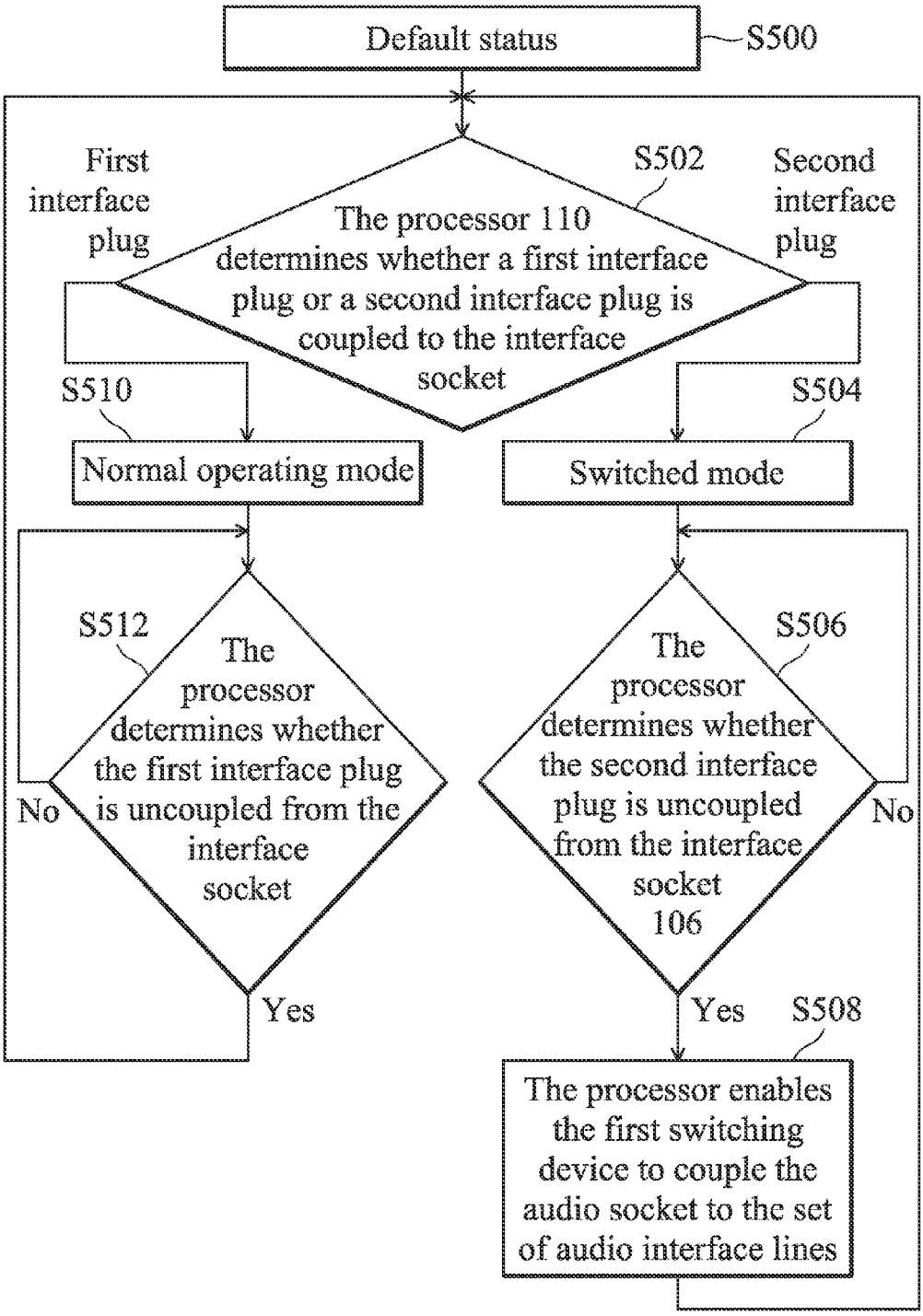
FIG. 5 is a flowchart of an operation switching method according to an embodiment of the present invention.

FIG. 5 is a flowchart of an operation switching method according to an embodiment of the present invention, and the operation switching method is applied to the interface switching system 1000. The process starts at step S500.

In step S500, the processor 110 enables the first switching device 104 to couple the audio socket 102 to the set of audio interface lines AL1 and enables the second switching device 108 to couple the interface socket 106 to the set of interface lines IL2. It should be noted that, in this embodiment, the default status of the audio socket 102 is coupled to the set of audio interface lines AL1, and the default status of the interface socket 106 is coupled to the set of interface lines IL2.

Next, in step S502, the processor 110 is arranged to determine whether a first interface plug or a second interface plug is coupled to the interface socket 106. For example, when the interface socket 106 is coupled to the second interface plug, the interface socket 106 receives a first identification signal S1 from the second interface plug and transmits the first identification signal S1 to the second switching device 108. Moreover, the second switching device 108 is further arranged to produce a second identification signal S2 according to the first identification signal S1, and transmit the second identification signal S2 to the processor 110. The processor 110 can determine whether the interface socket 106 is coupled to the second interface plug according to the second identification signal S2 produced by the second switching device 108. Furthermore, when the interface socket 106 is coupled to the first interface plug, the interface socket 106 receives a third identification signal S3 from the first interface plug, and transmits the third identification signal S3 to the second switching device 108. Moreover, the second switching device 108 produces a fourth identification signal S4 according to the third identification signal S3, and transmits the fourth identification signal S4 to the processor 110. The processor 110 can determine whether the interface socket 106 is coupled to the first interface plug according to the fourth identification signal S4 produced by the second switching device 108. When the interface socket 106 is coupled to the first interface plug, the process goes to step S510. When the interface socket is coupled to the second interface plug, the process goes to step S504. When the interface socket 106 is not coupled to any plugs, the processor 110 continues to determine whether the interface socket 106 is coupled to a first interface plug or a second interface plug.

In step S504, the processor 110 enables the electronic device 100 to operate in a switched mode. In the switched mode, the processor 110 enables the first switching device 104 to uncouple the audio socket 102 from the set of audio interface lines AL1 and couple the audio socket 102 to a set of interface lines IL1, and enables the second switching device 108 to uncouple the interface socket 106 from the set of interface lines IL2 and couple the interface socket 106 to the set of interface lines IL3. Next, the interface device 114 of the processor 110 transmits data DIV which meets the first interface specification to the audio plug and receives data DI1' which meets the first interface specification from the audio plug through the interface lines IL1 and the set of interface lines IL4. Moreover, the second interface device 115 of the processor 110 is arranged to transmit data DI2 which meets the second interface specification to the interface plug and receive data DI2 which meets the second interface specification from the interface plug through the set of interface lines IL3 and the set of interface lines IL5. In one embodiment, the first interface specification is the Universal Serial Bus (USB) standard, and the second interface specification is the Mobile High-Definition Link (MHL) standard.

Next, in step S506, the processor 110 is arranged to determine whether the second interface plug is uncoupled from the interface socket 106. For example, when the second interface plug is uncoupled from the interface socket 106, the interface socket 106 produces a fifth identification signal S5, and transmits the fifth identification signal S5 to the second switching device 108. The second switching device 108 produces a sixth identification signal S6 according to the fifth identification signal S5 and transmits the sixth identification signal S6 to the processor 110. Therefore, the processor 110 can determine that the second interface plug is uncoupled from the interface socket 106 according to the sixth identification signal S6. When the second interface plug is uncoupled from the interface socket 106, the process goes to step S508, otherwise, the processor 110 continues to determine whether the second interface plug is uncoupled from the interface socket 106.

In step S508, the processor 110 enables the electronic device 100 to return to operating in the normal operating mode, and enables the first switching device 104 to uncouple the audio socket 102 from the set of interface lines IL1 and couple the audio socket 102 to the set of audio interface lines AL1. Next, the process returns to step S502, and the processor 110 continues to determine whether the interface socket 106 is coupled to the first interface plug or the second interface plug.

In step S510, the processor 110 enables the electronic device 100 to operate in the normal operating mode. In the normal operating mode, the processor 110 enables the first switching device 104 to couple the audio socket 102 to the set of audio interface lines AL1 and uncouple the audio socket 102 from the first set of interface lines IL1, and enables the second switching device 108 to couple the interface socket 106 to the set of interface lines IL2 and uncouple the interface socket 106 from the set of interface lines IL3. Next, the audio interface device 112 of the processor 110 is arranged to transmit audio data DA1 which meets the audio interface specification to the audio plug and receive audio data DA1 which meets the audio interface specification from the audio plug through the set of audio interface lines AL1 and the set of interface lines IL4. Moreover, the interface device 116 of the processor 110 is arranged to transmit data DI1 which meets the first interface specification to the interface socket 106 and receive data DI1 which meets the first interface specification from the interface socket 106 through the set of interface lines IL2 and the set of interface lines IL5.

Next, in step S512, the processor 110 is arranged to determine whether the first interface plug is uncoupled from the interface socket 106. For example, when the first interface plug is uncoupled from the interface socket 106, the interface socket 106 produces a seventh identification signal S7 and transmits the seventh identification signal S7 to the second switching device 108. The second switching device 108 produces an eighth identification signal S8 according to the seventh identification signal S7, and transmits the eighth identification signal S8 to the processor 110. Therefore, the processor 110 can determine that the first interface plug is uncoupled from the interface socket 106 according to the eighth identification signal S8. When the first interface plug is uncoupled from the interface socket 106, the process goes back to step S502, otherwise, the processor 110 continues to determine whether the first interface plug is uncoupled from the interface socket 106. The identification signals of the embodiments can be voltage signals with the same voltage or different voltages, and it is not limited thereto. It should be noted that the first identification signal S1 and the third identification signal S3 must be voltage signals with different voltages.

The present invention provides an interface switching system 1000 and an operation switching method arranged to operate in different operation modes according to the connected plug. Namely, the interface switching system 1000 and the operation switching method are arranged to allow the audio socket 102 to serve as the output/input port of the first interface when the interface socket 106 which is shared for the first interface and the second interface is connected to the plug of the second interface, such that the limited socket can be effectively used. It should be noted that, in one of the embodiments, the first interface is a Universal Serial Bus (USB) and the second interface is a Mobile High-Definition Link (MHL), wherein the MHL can transfer the audio data. Therefore, when the second interface plug is coupled to the electronic device 100, the utilization rate of the audio socket 102 will be significantly lower, such that the interface socket 106 can be replaced by the audio socket 102 for transmitting the data of the USB.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An interface switching system, comprising an electronic device, wherein the electronic device comprises:

an audio socket, compatible with a first audio plug meeting an audio interface specification and a second audio plug meeting a first interface specification;

a first set of interface lines, meeting the first interface specification;

a set of audio interface lines, meeting the audio interface specification;

a first switching device, arranged to couple the audio socket to the first set of interface lines or the set of audio interface lines;

an interface socket, compatible with a first interface plug meeting the first interface specification and a second interface plug meeting a second interface specification, wherein the first interface plug and the second interface plug cannot plug in the interface socket at the same time; and a processor, configured to determine a status of the interface socket and enable the first switching device to couple the audio socket to the first set of interface lines in response to the status of the interface socket, wherein the processor enables the first switching device to couple the audio socket to the first set of interface lines when the interface socket is coupled to the second interface plug.

2. The interface switching system as claimed in claim 1, wherein the electronic device further comprises:

a second set of interface lines;

a third set of interface lines; and a second switching device, arranged to couple the interface socket to the second set of interface lines when the interface socket is coupled to the first interface plug, and couple the interface socket to the third set of interface lines when the interface socket is coupled to the second interface plug.

3. The interface switching system as claimed in claim 2, wherein the processor of the electronic device further comprises:

an audio interface device, arranged to transmit data meeting the audio interface specification through the set of audio interface lines to the first audio plug and receive data meeting the audio interface specification from the first audio plug when the interface socket is coupled to the first interface plug;

a first interface device, arranged to transmit data meeting the first interface specification through the first set of interface lines to the second audio plug and receive data meeting the first interface specification from the second audio plug when the interface socket is coupled to the second interface plug; and a second interface device, arranged to transmit data meeting the second interface specification through the third set of interface lines to the second interface plug and receive data meeting the second interface specification from the second interface plug when the interface socket is coupled to the second interface plug.

4. The interface switching system as claimed in claim 3, wherein the processor of the electronic device further comprises a third interface device arranged to transmit data through the second set of interface lines to the interface socket and receive data meeting the first interface specification from the interface socket when the interface socket is coupled to the first interface plug.

5. The interface switching system as claimed in claim 3, wherein the first interface device is further arranged to transmit data meeting the first interface specification through the second set of interface lines to the interface socket and receive data meeting the first interface specification from the interface socket when the interface socket is coupled to the first interface plug, wherein the second set of interface lines is connected to the first set of interface lines.

6. The interface switching system as claimed in claim 2, wherein the first interface specification is a Universal Serial Bus standard, and the second interface specification is a Mobile High-Definition Link standard.

7. The interface switching system as claimed in claim 1, further comprising an external device, wherein the external device comprises:

a first external interface port;

an external interface transmitter, arranged to transmit data meeting the first interface specification received by the first external interface port to the electronic device by the second audio plug, and transmit data meeting the first interface specification received from the electronic device to the first external interface port;

a third external interface port; and a decoder, arranged to convert data meeting a third interface specification received from the third external interface port to data meeting the second interface specification and transmit the converted data meeting the second interface specification to the electronic device by the second interface plug, and convert data meeting the second interface specification received from the electronic device to data meeting the third interface specification and transmit the converted data meeting the third interface specification to the third external interface port.

8. An operation switching method, applied to an interface switching system having an audio socket and an interface socket, wherein the audio socket is compatible with a first audio plug meeting an audio interface specification and a second audio plug meeting a first interface specification, the interface socket is compatible with a first interface plug meeting the first interface specification and a second interface plug meeting a second interface specification, and the first interface plug and the second interface plug cannot plug in the interface socket at the same time, comprising:

coupling the audio socket to a set of audio interface lines meeting the audio interface specification;

determining whether the interface socket is coupled to the first interface plug meeting the first interface specification or the second interface plug meeting the second interface specification to determine a status of the interface socket; and switching the audio socket in response to the status of the interface socket, wherein the step of switching the audio socket in response to the status of the interface socket further comprises:

uncoupling the audio socket from the set of audio interface lines and coupling the audio socket to a first set of interface lines meeting the first interface specification when the interface socket is coupled to the second interface plug.

9. The operation switching method as claimed in claim 8, comprising:

coupling the interface socket to a second set of interface lines; and uncoupling the interface socket from the second set of interface lines and coupling the interface socket to a third set of interface lines when the interface socket is coupled to the second interface plug.

10. The operation switching method as claimed in claim 9, when the interface socket is coupled to the second interface plug, the method further comprising:

transmitting data meeting the first interface specification through the first set of interface lines to the second audio plug, and receiving data meeting the first interface specification from the second audio plug; and transmitting data meeting the second interface specification through the third set of interface lines to the second interface plug, and receiving data meeting the second interface specification from the second interface plug.

11. The operation switching method as claimed in claim 9, wherein the second set of interface lines is connected to the first set of interface lines.

12. The operation switching method as claimed in claim 9, wherein the first interface specification is a Universal Serial Bus standard, and the second interface specification is the Mobile High-Definition Link standard.

13. The operation switching method as claimed in claim 9, when the interface socket is coupled to the first interface plug, the method further comprising:

coupling the audio socket to the set of audio interface lines, and uncoupling the audio socket from the first set of interface lines; and coupling the interface socket to the second set of interface lines, and uncoupling the interface socket from the third set of interface lines.

14. The operation switching method as claimed in claim 13, wherein the interface socket is coupled to the first interface plug, the method further comprising:

transmitting data meeting the audio interface specification to the first audio plug through the set of audio interface lines, and receiving data meeting the audio interface specification from the first audio plug; and transmitting data meeting the first interface specification to the interface socket through the second set of interface lines, and receiving data meeting the first interface specification from the interface socket.

* * * * *